US010697639B2

(12) United States Patent
Johnson et al.

(10) Patent No.: US 10,697,639 B2
(45) Date of Patent: Jun. 30, 2020

(54) DUAL-FUEL FUEL NOZZLE WITH LIQUID FUEL TIP

(71) Applicant: General Electric Company, Schenectady, NY (US)

(72) Inventors: Thomas Edward Johnson, Greer, SC (US); Kaitlin Marie Graham, Greenville, SC (US); Geoffrey David Myers, Simpsonville, SC (US)

(73) Assignee: General Electric Compamy, Schenectady, NY (US)

( * ) Notice: Subject to any disclaimer, the term of this patent is extended or adjusted under 35 U.S.C. 154(b) by 442 days.

(21) Appl. No.: 15/460,398

(22) Filed: Mar. 16, 2017

(65) Prior Publication Data

US 2018/0266694 A1 Sep. 20, 2018

(51) Int. Cl.

| | |
|---|---|
| ***F23R 3/36*** | (2006.01) |
| ***F23R 3/28*** | (2006.01) |
| ***F23R 3/14*** | (2006.01) |
| ***F23R 3/34*** | (2006.01) |
| ***F23D 17/00*** | (2006.01) |

(52) U.S. Cl.

CPC ..... *F23R 3/36* (2013.01); *F23D 17/002* (2013.01); *F23R 3/14* (2013.01); *F23R 3/283* (2013.01); *F23R 3/286* (2013.01); *F23R 3/343* (2013.01); *F23D 2900/00015* (2013.01); *F23R 2900/03044* (2013.01)

(58) Field of Classification Search

CPC .. F23R 3/14; F23R 3/283; F23R 3/286; F23R 3/343; F23R 3/346; F23R 3/36; F23R 2900/03343

See application file for complete search history.

(56) References Cited

U.S. PATENT DOCUMENTS

| | | | | |
|---|---|---|---|---|
| 1,709,727 A | | 4/1929 | Knudsen | |
| 3,638,865 A | * | 2/1972 | McEneny | F23D 11/26 239/424 |
| 3,758,258 A | | 9/1973 | Kolhi | |

(Continued)

FOREIGN PATENT DOCUMENTS

| | | | |
|---|---|---|---|
| EP | 1835231 | A1 | 9/2007 |
| EP | 2390572 | A2 | 11/2011 |
| WO | WO2014/081334 | A1 | 5/2014 |

OTHER PUBLICATIONS

European Search Report Corresponding to Application No. 18161482 dated Jul. 23, 2018.

*Primary Examiner* — Arun Goyal

(74) *Attorney, Agent, or Firm* — Dority & Manning, P.A.

(57) ABSTRACT

A dual-fuel fuel nozzle includes a centerbody that at least partially defines an air plenum therein. A tip body is disposed at a downstream end of the centerbody. The tip body includes an upstream side that is axially spaced from a downstream side. The downstream side defines a circular slot and a circular recess that is positioned radially inwardly from the circular slot. The circular recess includes a floor and a side wall, The floor defines an insert opening and the side wall defines an annular groove that includes an undercut surface. The tip body further defines a plurality of orifices annularly arranged around the insert opening radially inward from the side wall of the circular recess. Each orifice includes an inlet that is in fluid communication with the air plenum and an outlet that is oriented towards the undercut surface.

17 Claims, 4 Drawing Sheets

(56) References Cited

U.S. PATENT DOCUMENTS

| | | | | |
|---|---|---|---|---|
| 3,881,863 | A | 5/1975 | Creuz | |
| 5,404,711 | A | 4/1995 | Rajput | |
| 7,007,477 | B2 * | 3/2006 | Widener | F23D 14/78 60/737 |
| 8,079,218 | B2 * | 12/2011 | Widener | F23D 14/48 60/737 |
| 2008/0066720 | A1 | 3/2008 | Piper et al. | |
| 2011/0005229 | A1 | 1/2011 | Vankataraman et al. | |
| 2011/0314827 | A1 * | 12/2011 | Khosla | F23R 3/14 60/742 |
| 2014/0190168 | A1 | 7/2014 | Shershnyov et al. | |
| 2015/0135716 | A1 * | 5/2015 | Ginessin | F23R 3/28 60/737 |
| 2017/0080530 | A1 * | 3/2017 | McGhee | B23P 6/005 |

* cited by examiner

DUAL-FUEL FUEL NOZZLE WITH LIQUID FUEL TIP

FIELD

The subject matter disclosed herein relates to a fuel nozzle for a combustion system. More particularly, the disclosure is directed to a dual-fuel fuel nozzle with a liquid fuel tip.

BACKGROUND

Gas turbines generally operate by combusting a fuel and air mixture in one or more combustors to create a high-energy combustion gas that passes through a turbine, thereby causing a turbine rotor shaft to rotate. The rotational energy of the rotor shaft may be converted to electrical energy via a generator coupled to the rotor shaft. Each combustor generally includes fuel nozzles that provide for premixing of the fuel and air upstream of a combustion zone, as a means to keep nitrogen oxide (NOx) emissions low.

Gaseous fuels, such as natural gas, often are employed as a combustible fluid in gas turbine engines used to generate electricity. In some instances, it may be desirable for the combustion system to be able to combust liquid fuels, such as distillate oil, with no changes to the combustion hardware. A configuration with both gas and liquid fuel capability is called a "dual-fuel" combustion system. In a typical configuration, liquid fuel injection may be provided via a cartridge that extends within a centerbody of the fuel nozzle. While serving as an effective means for delivering the liquid fuel to the combustion zone of the combustor, the cartridge increases overall component count and cost of assembly.

BRIEF DESCRIPTION

Aspects and advantages are set forth below in the following description, or may be obvious from the description, or may be learned through practice.

One embodiment of the present disclosure is a dual-fuel fuel nozzle includes a centerbody that at least partially defines an air plenum therein. A tip body is disposed at a downstream end of the centerbody. The tip body includes an upstream side that is axially spaced from a downstream side. The downstream side defines a circular slot and a circular recess that is positioned radially inwardly from the circular slot. The circular recess includes a floor and a side wall. The floor defines an insert opening and the side wall defines an annular groove that includes an undercut surface. The tip body further defines a plurality of orifices annularly arranged around the insert opening radially inward from the side wall of the circular recess. Each orifice includes an inlet that is in fluid communication with the air plenum and an outlet that is oriented towards the undercut surface.

Another embodiment of the present disclosure is directed to a combustor. The combustor includes an end cover that is coupled to an outer casing. A dual-fuel fuel nozzle is coupled to the end cover. The dual-fuel fuel nozzle comprises an outer sleeve, a center body that extends axially through the outer sleeve. The outer sleeve and the centerbody are radially spaced to form a premix passage therebetween and a plurality of turning vanes extends radially between the centerbody and the outer sleeve within the premix passage. A tip body is disposed at a downstream end of the centerbody. The tip body includes an upstream side that is axially spaced from a downstream side. The downstream side defines a circular slot and a circular recess positioned radially inwardly from the circular slot. The circular recess comprises a floor and a side wall where the floor defines an insert opening and the side wall defines an annular groove. The annular groove defines an undercut surface. The tip body further defines a plurality of orifices annularly arranged around the insert opening radially inward from the side wall of the circular recess. Each orifice includes an inlet that is in fluid communication with an air plenum defined within the centerbody and an outlet that is oriented towards the undercut surface.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode thereof to one skilled in the art, is set forth more particularly in the remainder of the specification, including reference to the accompanying figures, in which.

DETAILED DESCRIPTION

Figure 1:
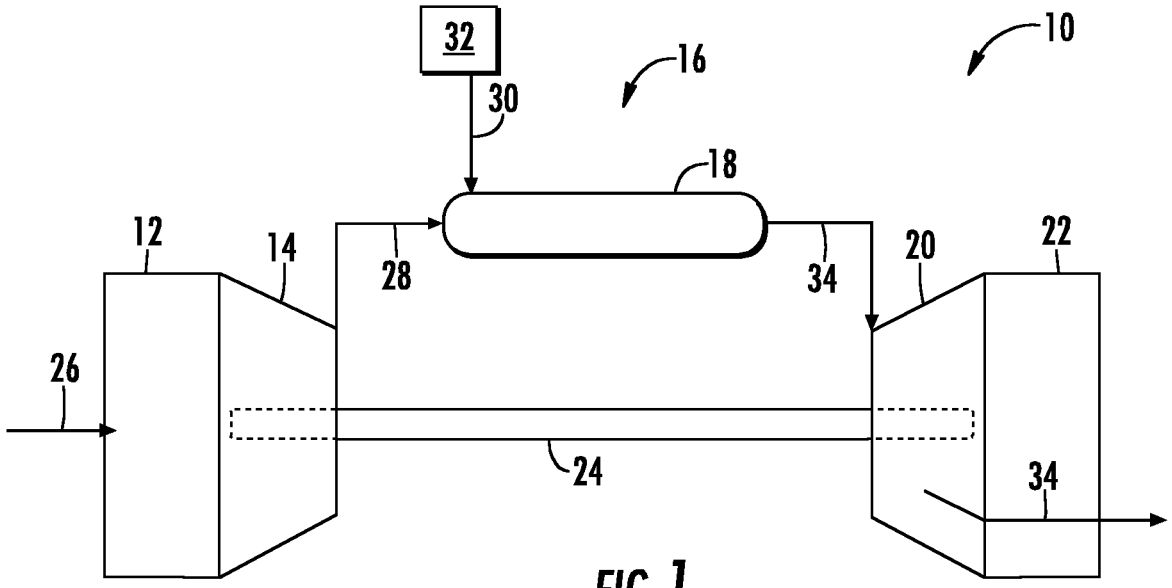
FIG. 1 is a functional block diagram of an exemplary gas turbine that may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel and/or coaxially aligned to an axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising,"

when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a fuel nozzle for a land based power generating gas turbine combustor for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited in the claims.

Referring now to the drawings, FIG. 1 illustrates a schematic diagram of an exemplary gas turbine 10. The gas turbine 10 generally includes an inlet section 12, a compressor 14 disposed downstream of the inlet section 12, a combustion system 16 including at least one combustor 18 disposed downstream of the compressor 14, a turbine 20 disposed downstream of the combustor 18 and an exhaust section 22 disposed downstream of the turbine 20. Additionally, the gas turbine 10 may include one or more shafts 24 that couple the compressor 14 to the turbine 20.

During operation, air 26 flows through the inlet section 12 and into the compressor 14 where the air 26 is progressively compressed, thus providing compressed air 28 to the combustor 18. A fluid such as fuel, gas or water 30 from a fluid supply 32 is injected into the combustor 18, mixed with a portion of the compressed air 28 and burned to produce combustion gases 34. The combustion gases 34 flow from the combustor 18 into the turbine 20, wherein energy (kinetic and/or thermal) is transferred from the combustion gases 34 to rotor blades (not shown), thus causing shaft 24 to rotate. The mechanical rotational energy may then be used for various purposes such as to power the compressor 14 and/or to generate electricity. The combustion gases 34 exiting the turbine 20 may then be exhausted from the gas turbine 10 via the exhaust section 22.

Figure 2:
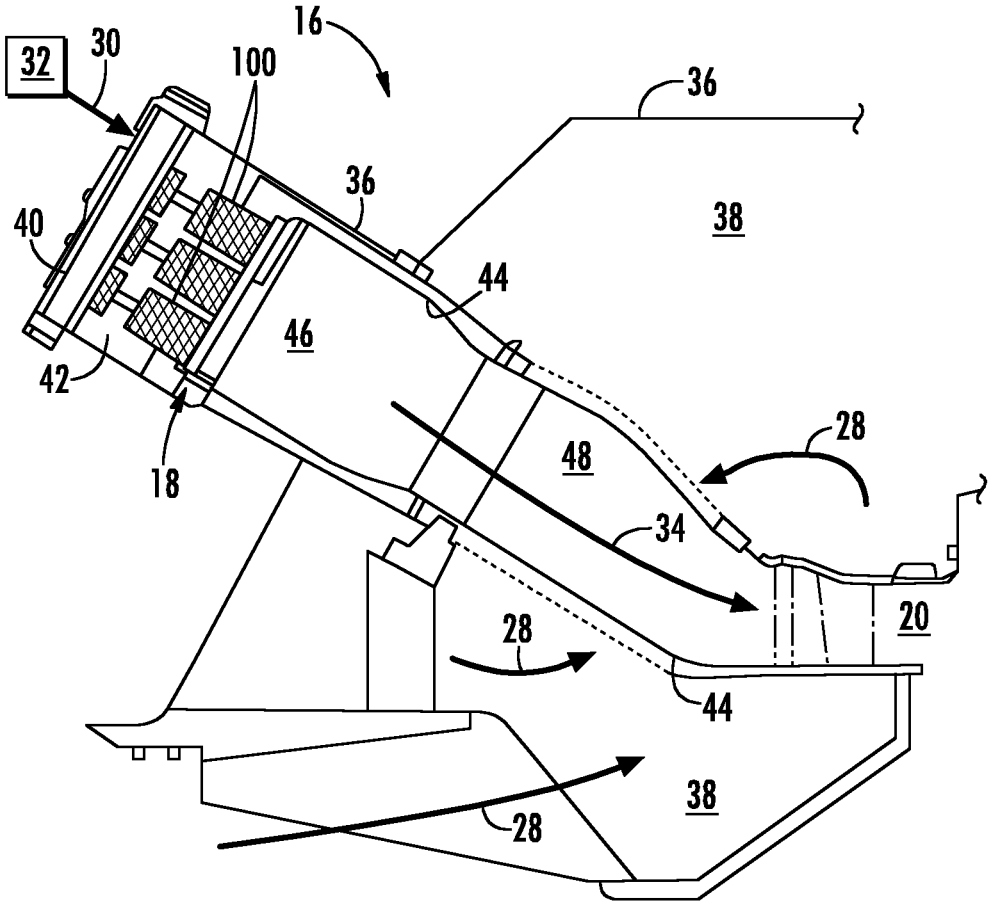
FIG. 2 is a simplified cross-section side view of an exemplary combustor as may incorporate various embodiments of the present disclosure.

FIG. 2 provides a cross-sectioned schematic of an exemplary combustor 18 as may incorporate various embodiments of the present disclosure. As shown in FIG. 2, the combustor 18 may be at least partially surrounded an outer casing 36 such as a compressor discharge casing. The outer casing 36 may at least partially define a high pressure plenum 38 that at least partially surrounds various components of the combustor 18. The high pressure plenum 38 may be in fluid communication with the compressor 16 (FIG. 1) so as to receive the compressed air 28 therefrom. An end cover 40 may be coupled to the outer casing 36. In particular embodiments, the outer casing 36 and the end cover 40 may at least partially define a head end volume or portion 42 of the combustor 18. In particular embodiments, the head end portion 42 is in fluid communication with the high pressure plenum 38 and/or the compressor 14. One or more liners or ducts 44 may at least partially define a combustion chamber or zone 46 for combusting the fuel-air mixture and/or may at least partially define a hot gas path 48 through the combustor for directing the combustion gases 34 towards an inlet to the turbine 20.

In various embodiments, as shown in FIG. 2, the combustor 18 includes one or more fuel nozzles 100 coupled to the end cover 40 and extending towards the combustion chamber 46. Various embodiments of the combustor 18 may include different numbers and arrangements of fuel nozzles 100 and is not limited to any particular number of fuel nozzles unless otherwise specified in the claims. For example, in particular configurations the one or more fuel nozzles 100 may include multiple fuel nozzles annularly arranged about a center fuel nozzle.

Figure 3:
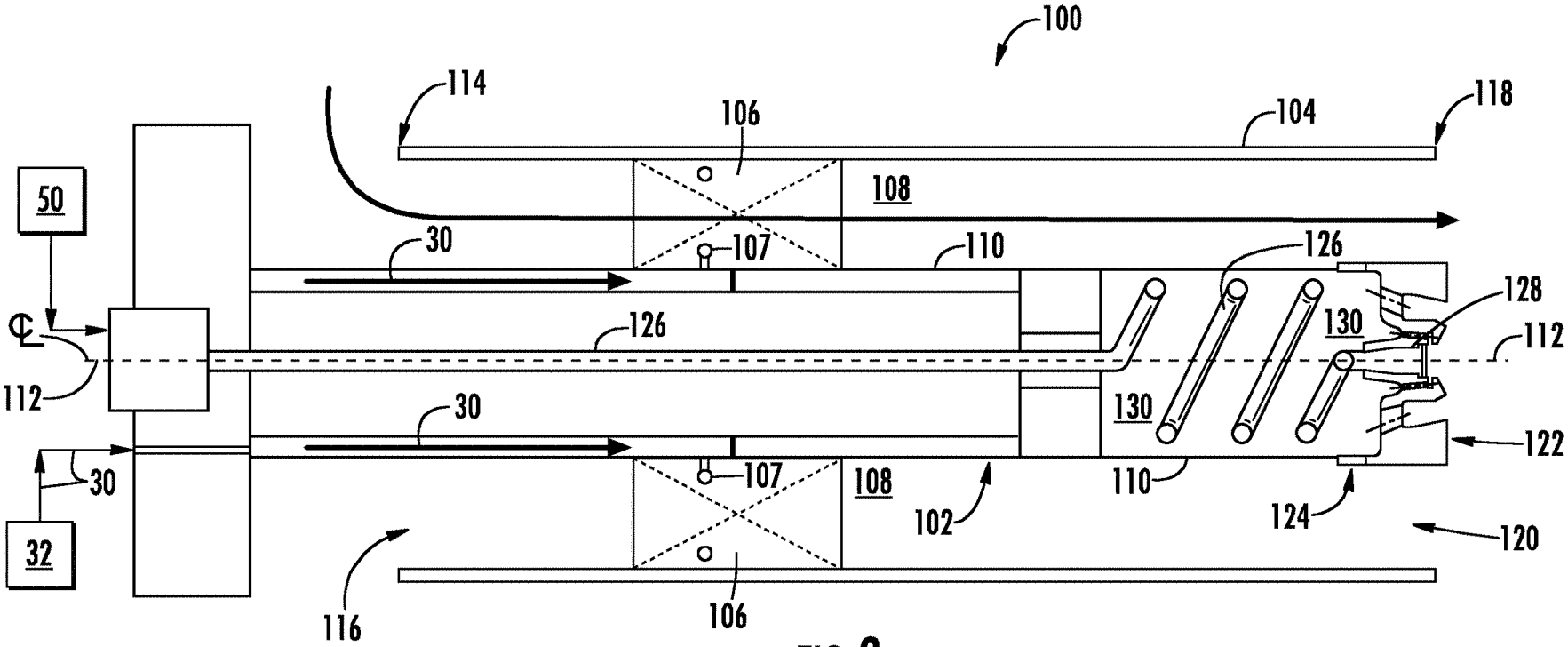
FIG. 3 is a cross sectional side view of an exemplary fuel nozzle as may incorporate one or more embodiments of the present disclosure.

FIG. 3 provides a cross-sectional side view of an exemplary dual-fuel type fuel nozzle 100 according to at least one embodiment of the present disclosure. As shown in FIG. 3, the fuel nozzle 100 includes a center body 102 having an annular or tube shape. In particular embodiments, the fuel nozzle 100 may include an outer sleeve or burner tube 104 that extends circumferentially around at least a portion of the center body 102 and a plurality of turning vanes 106 that extend between the center body 102 and the outer sleeve 104. The turning vanes 106 are disposed within a premix air passage 108 which is defined between the center body 102 and the outer sleeve 104. In particular embodiments, one or more of the turning vanes includes a respective fuel port 107 which is in fluid communication with the fluid supply 32.

The center body 102 may be formed from one or more sleeves or tubes 110 coaxially aligned with a longitudinal axis or axial centerline 112 of the fuel nozzle 100. The fuel nozzle 100 may be connected to an inner surface of the end cover 40 via mechanical fasteners or by other connecting means (not shown).

In particular embodiments, an upstream end portion 114 of the outer sleeve 104 may at least partially define an inlet 116 to the premix air passage 108 and a downstream end portion 118 of the outer sleeve 104 may at least partially define an outlet 120 of the premix air passage 108. In at least one embodiment, the inlet 116 is in fluid communication with the head end 42 (FIG. 2) of the combustor 18.

Figure 4:
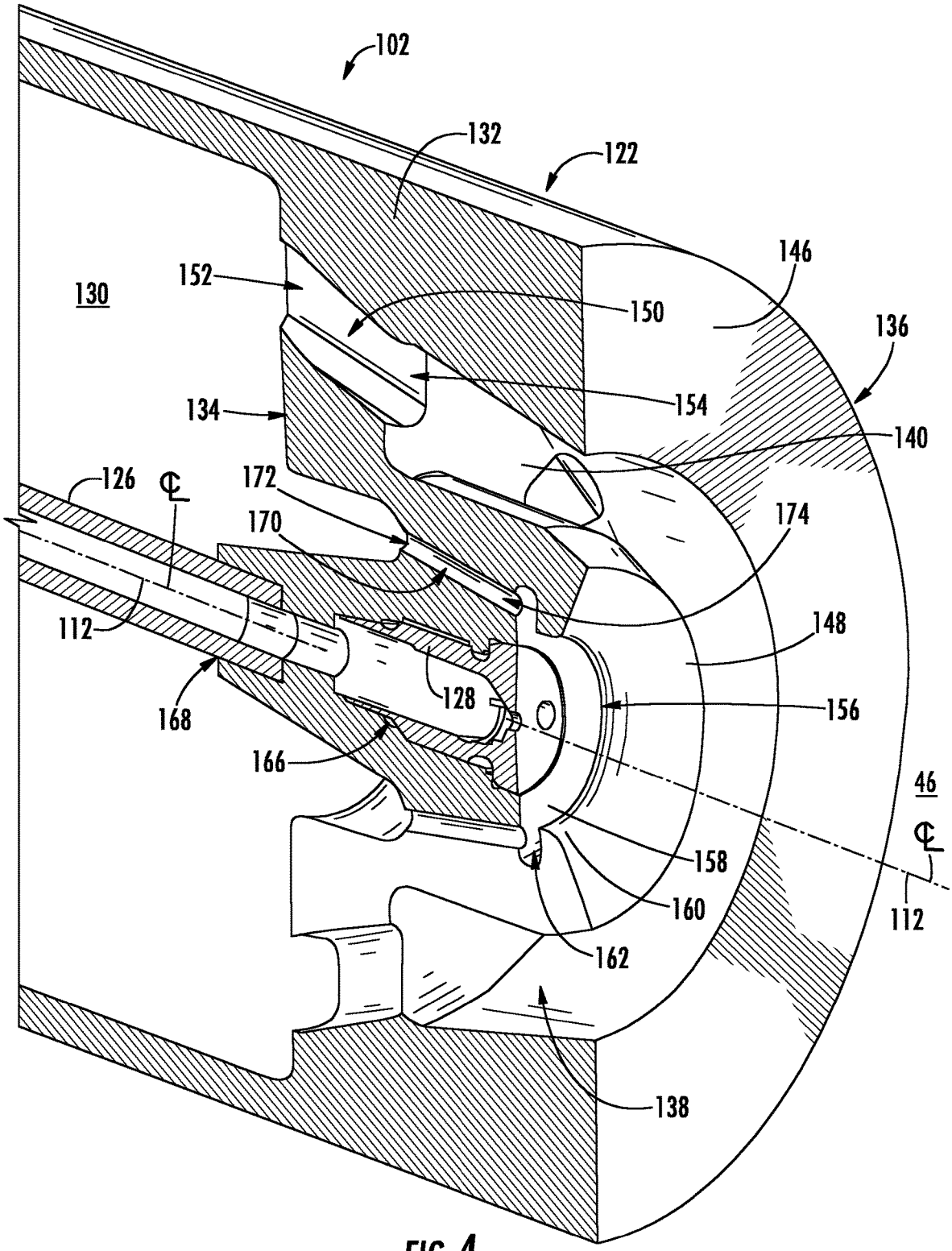
FIG. 4 is an enlarged cross-sectioned perspective view of a portion of a centerbody portion of the fuel nozzle as shown in FIG. 3, according to at least one embodiment of the present disclosure.
Figure 5:
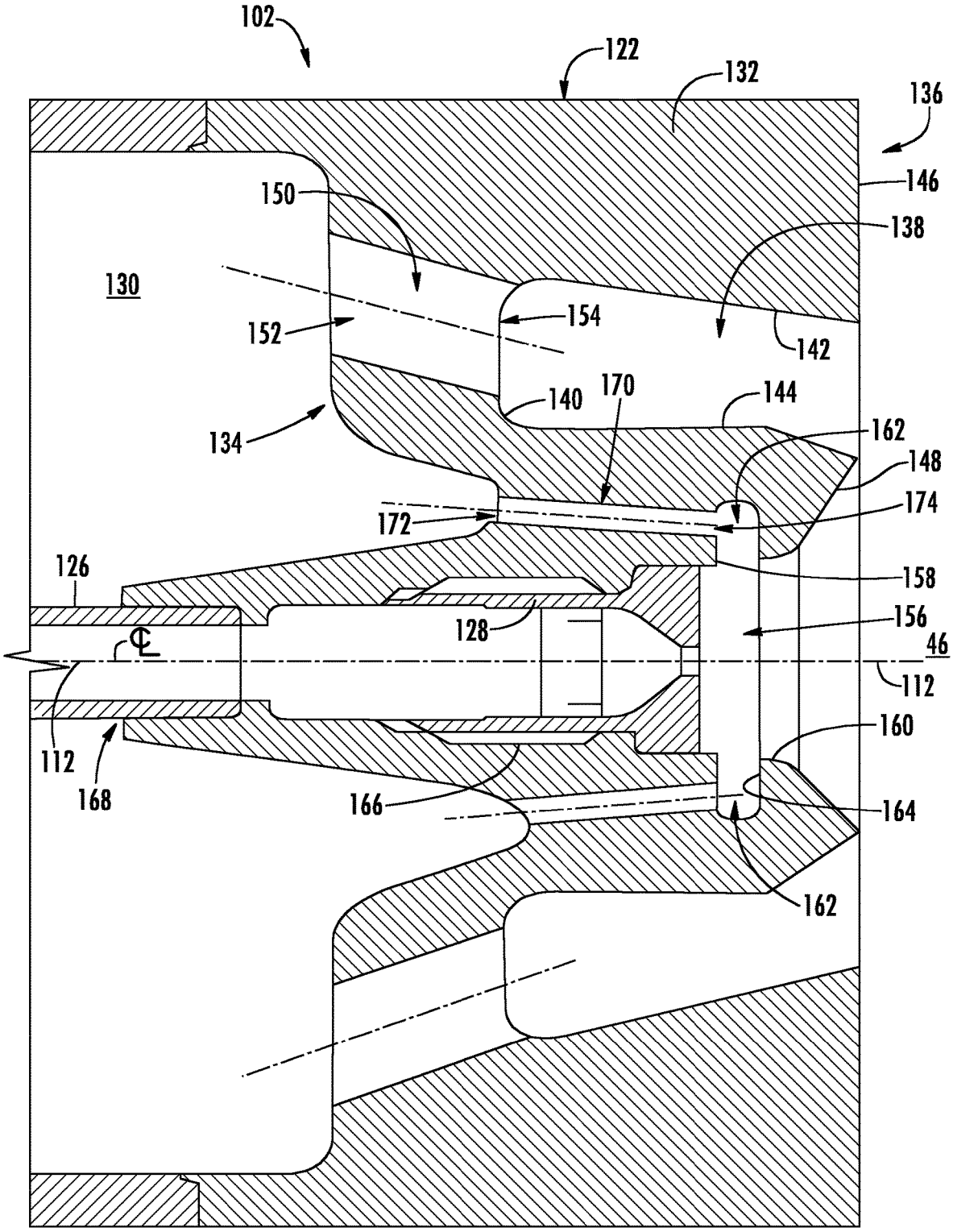
FIG. 5 is an enlarged cross-sectioned side view of a portion of a centerbody portion of the fuel nozzle as shown in FIG. 4, according to at least one embodiment of the present disclosure.

FIG. 4 provides a cross-sectioned perspective view of a portion of the centerbody 102 as shown in FIG. 3, according to various embodiments of the present disclosure. FIG. 5 provides a cross-sectioned side view of the portion of the centerbody 102 as shown in FIG. 4, according to at least one embodiment of the present disclosure. In various embodiments, as shown in FIGS. 3 through 5 collectively, a pilot tip 122 is disposed at a downstream end 124 of the centerbody 102 and or the tube(s) 110. A conduit 126 extends within the tube(s) 110 of the centerbody 102 and provides for fluid communication between a liquid fuel supply 50 (FIG. 3) and an atomizer insert 128 which is removably fixed to the pilot tip 122. In particular embodiments, as shown in FIG. 3, at least a portion of the conduit 126 may be helical or extend helically within the centerbody 102. In various embodiments, as shown in FIGS. 3 through 5 collectively, the centerbody 102 includes an air plenum 130 defined within the tube(s) 110. In particular embodiments, at least a portion of the conduit 126 extends through the air plenum 130.

In various embodiments, as shown collectively in FIGS. 4 and 5, the pilot tip 122 is formed from a tip body 132. The tip body 132 includes and/or defines a forward or upstream side 134 and an aft or downstream side 136. A circular or annular slot 138 is defined in the downstream side 136 of the tip body 132. The circular slot 138 includes a floor 140. As shown in FIG. 5, the slot further includes a pair of radially opposing side walls 142, 144. In various embodiments, as shown in FIG. 5, walls 142, 144 may converge or may be tilted towards each other between the floor 140 and the downstream side 136 of the tip body 132. As shown in FIGS. 4 and 5 collectively, the circular slot 138 radially splits the downstream side 136 into a radially outer surface or face 146 and a radially inner surface or face 148.

In various embodiments, as shown in FIGS. 4 and 5 collectively, the tip body 132 defines a plurality of apertures 150 that extends through the forward side 134 and the floor 140 of the circular slot 138. The apertures 150 are annularly arranged with respect to centerline 112. Each aperture 150 includes an inlet 152 that is in fluid communication with the air plenum and an outlet 154 that is defined along the floor 140. Each aperture 150 provides for fluid flow from the air plenum 130 through the tip body 132, into the slot 138 and into the combustion chamber 46. In particular embodiments, each or at least some of the apertures 150 may be angled, slanted or otherwise formed with respect to centerline 112 so as to impart angular swirl to air flowing therethrough.

In various embodiments, as shown in FIGS. 4 and 5, the tip body 132 defines a circular recess 156 disposed along the radially inner surface 148. The circular recess 156 may be substantially coaxially aligned with centerline 112. The circular recess 156 includes a floor 158 and a side wall 160 that extends axially outwardly from the floor 158. The side wall 160 defines an annular groove 162 which extends radially into and circumferentially within the side wall 160. As shown most clearly in FIG. 5, the annular groove 162 forms an undercut surface 164 within the side wall 160.

In particular embodiments, a portion of the inner face 148 diverges radially outwardly along centerline 112 aft of or downstream from the undercut surface 164. In particular embodiments the tip body 132 defines an insert opening 166 disposed along the floor 158 of the circular recess 156. The atomizer insert 128 is removably seated, threaded or otherwise secured within the insert opening 166. The tip body 132 further defines an inlet 168 to allow flow to insert opening 166. The inlet 168 is connected to and/or fluidly coupled to the conduit 126 so as to receive a liquid fuel or other fluid such as air, gas or water, from the liquid-fuel fuel supply 50 (FIG. 3).

In various embodiments, as shown in FIGS. 4 and 5, the tip body 132 further defines a plurality of orifices 170 that extend through the forward side 134 of the tip body 122 and the floor 158 of the circular recess 156. The orifices 170 are annularly arranged around the insert opening 166 with respect to centerline 112 and disposed radially inward from the plurality of apertures 150. Each orifice 170 of the plurality of orifices 170 includes a respective inlet 172 and a respective outlet 174 and provides for fluid flow from the air plenum 130 through the tip body 132 and into the combustion chamber 46. In particular embodiments, each of the orifices 170 may be angled, slanted or otherwise formed with respect to centerline 112 so as to impart angular swirl to air flowing therethrough. A respective outlet 174 of each orifice 170 is positioned and/or angled towards the undercut surface 164.

During operation, the air plenum 130 is charged with compressed air from the high pressure plenum 38 or another compressed air source. Liquid fuel is supplied to the atomizer insert 128 via conduit 126. The liquid fuel is atomized via the atomizer insert 128 and is ejected out of the circular recess 156 towards the combustion chamber 46. A first portion of the compressed air flows from the air plenum 130, through the plurality of apertures 150 and is directed downstream from the downstream side 136 of the tip body 132 towards the combustion chamber 46 where it mixes with the atomized liquid fuel. A second portion of the compressed air flows from the air plenum 130 and through the plurality of apertures 170. The second portion of compressed air impinges upon the undercut surface 164 of the circular recess, thereby providing cooling thereto. In addition, the pressure of the second portion of compressed air may prevent flame holding and/or backflow of combustion gases into the atomizer insert which may be caused by pressure differences from nozzle to nozzle in area 156 and the fact that the conduits are fluidically connected at the fluid supply 32.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dual-fuel fuel nozzle, comprising: a centerbody, wherein the centerbody at least partially defines an air plenum therein;

a tip body disposed at a downstream end of the centerbody, the tip body having an upstream side axially spaced from a downstream side, the downstream side defining a circular slot and a circular recess positioned radially inwardly from the circular slot, the circular recess comprising a first floor and an annular side wall, the first floor defining an insert opening and the side wall defining an annular groove, wherein the annular groove defines an undercut surface, the tip body further defining a plurality of orifices annularly arranged around the insert opening and positioned radially inward from the side wall and upstream of the undercut surface of the circular recess, each of the plurality of the orifices including a first inlet in direct fluid communication with the air plenum and a first outlet defined along the first floor, wherein the first outlet is oriented towards the undercut surface and configured to direct a portion of compressed air from the air plenum to impinge upon the undercut surface of the annular groove, wherein the circular slot of the tip body includes a second floor and a plurality of apertures annularly arranged across the second floor, each aperture of the plurality of apertures extending from a second inlet immediately downstream of the air plenum to a second outlet defined along the second floor, wherein the plurality of apertures are disposed radially outward from the plurality of orifices.

2. The dual-fuel fuel nozzle as in claim 1, wherein the circular slot of the tip body includes a pair of radially opposing walls, wherein at least one of the radially opposing walls is angled radially inwardly or radially outwardly with respect to an axial centerline of the dual-fuel fuel nozzle.

3. The dual-fuel fuel nozzle as in claim 1, wherein the circular slot divides the downstream side into a radially outer surface and a radially inner surface, wherein the circular recess is defined within the radially inner surface.

4. The dual-fuel fuel nozzle as in claim 3, wherein a portion of the radially inner surface diverges radially outwardly aft of the annular groove.

5. The dual-fuel fuel nozzle as in claim 1, further comprising an atomizer insert removably seated within the insert opening.

6. The dual-fuel fuel nozzle as in claim 1, further comprising a conduit extending within the centerbody, wherein one end of the conduit is connected to an inlet of the insert opening and a second end of the conduit is fluidly coupled to a fluid supply.

7. The dual-fuel fuel nozzle as in claim 6, wherein at least a portion of the conduit extends helically within the centerbody upstream from the insert opening of the tip body.

8. The dual-fuel fuel nozzle as in claim 1, further comprising an outer sleeve that circumferentially surrounds at least a portion of the centerbody and a plurality of turning vanes that extend radially between the centerbody and the outer sleeve.

9. The dual-fuel fuel nozzle as in claim 2, wherein each turning vane of the plurality of turning vanes includes at least one fuel port in fluid communication with a gas-fuel fuel supply.

10. A combustor, comprising:

an end cover coupled to an outer casing;

a dual-fuel fuel nozzle coupled to the end cover, the dual-fuel fuel nozzle comprising, an outer sleeve, a centerbody extending axially through the outer sleeve wherein the outer sleeve and the centerbody are radially spaced to form a premix passage therebetween and a plurality of turning vanes that extend radially between the centerbody and the outer sleeve within the premix passage;

a tip body disposed at a downstream end of the centerbody, the Up body having an upstream side axially spaced from a downstream side, the downstream side defining a circular slot and a circular recess positioned radially inwardly from the circular slot, the circular recess comprising a first floor and an annular-a side wall, the first floor defining an insert opening and the side wall defining an annular groove, wherein the annular groove defines an undercut surface, the tip body further defining a plurality of orifices annularly arranged around the insert opening and positioned radially inward from the side wall and upstream of the undercut surface of the circular recess, each of the plurality of the orifices including a first inlet in direct fluid communication with an air plenum defined within the centerbody and a first outlet defined along the first floor, wherein the first outlet is oriented towards the undercut surface and configured to direct a portion of compressed air from the air plenum to impinge upon the undercut surface of the annular groove, wherein the circular slot of the tip body includes a second floor and a plurality of apertures annularly arranged across the second floor, each aperture of the plurality of apertures extending from a second inlet immediately downstream of the air plenum to a second outlet defined along the second floor, wherein the plurality of apertures are disposed radially outward from the plurality of orifices.

11. The combustor as in claim 10, wherein the circular, slot of the tip body includes a pair of radially opposing walls, wherein at least one of the radially opposing walls is angled radially, inwardly or radially outwardly with respect to an axial centerline of the dual-fuel fuel nozzle.

12. The combustor as in claim 10, wherein the circular slot divides the downstream side of the tip body into a radially outer surface and a radially inner surface, wherein the circular recess is defined within the radially inner surface.

13. The combustor as in claim 12, wherein a portion of the radially inner surface diverges radially outwardly aft of the annular groove.

14. The combustor as in claim 10, further comprising an atomizer insert removably seated within the insert opening.

15. The combustor as in claim 10, further comprising a conduit extending within the centerbody, wherein one end of the conduit is connected to an inlet of the insert opening and a second end of the conduit is fluidly coupled to a fluid supply.

16. The combustor as in claim 15, wherein at least a portion of the conduit extends helically within the centerbody upstream from the insert opening of the tip body.

17. The combustor as in claim 10, wherein each turning vane of the plurality of turning vanes includes at least one fuel port in fluid communication with a gas-fuel fuel supply.

* * * * *